US005442886A

United States Patent [19]

Iacobelli

[11] Patent Number: 5,442,886

[45] Date of Patent: Aug. 22, 1995

[54] PREFABRICATED CORNER BEAD

[76] Inventor: Luigi Iacobelli, 61 Cromdale Ridge, Woodbridge, Ontario, Canada, L4L 8C9

[21] Appl. No.: 169,176

[22] Filed: Dec. 20, 1993

[51] Int. Cl.[6] ..... F04B 2/00

[52] U.S. Cl. ..... 52/255; 52/257; 52/287.1; 52/417

[58] Field of Search ..... 52/746, 254, 255, 257, 52/416, 417, 287.1, 288.1

[56] References Cited

U.S. PATENT DOCUMENTS

| | | | |
|---|---|---|---|
| 658,386 | 9/1900 | Mitchell | 52/257 |
| 1,712,020 | 5/1929 | Baum | 52/257 |
| 2,851,741 | 9/1958 | Stemples | 52/255 |
| 3,090,087 | 5/1963 | Miller . | |
| 3,109,207 | 11/1963 | Cooper | 52/417 |
| 3,391,037 | 7/1968 | McNulty | 52/417 |
| 3,398,494 | 8/1968 | Larson | 52/255 |
| 3,412,512 | 11/1968 | Hollister | 52/256 |
| 3,922,408 | 11/1975 | Smith . | |
| 4,012,878 | 3/1977 | Ellingson . | |
| 4,863,774 | 9/1989 | Tucker . | |
| 4,999,233 | 3/1991 | Probst et al. . | |
| 5,022,212 | 6/1991 | Lippolt | 52/254 |
| 5,037,686 | 8/1991 | Conboy . | |
| 5,048,247 | 9/1991 | Weldy . | |
| 5,131,198 | 7/1992 | Ritchie et al. . | |
| 5,298,099 | 3/1994 | Hoffmann, Sr. | 156/94 |
| 5,311,717 | 5/1994 | Yount et al. | 52/417 |

FOREIGN PATENT DOCUMENTS

| | | | |
|---|---|---|---|
| 3303256 | 8/1984 | Germany | 52/256 |

*Primary Examiner*—Carl D. Friedman
*Assistant Examiner*—Winnie S. Yip
*Attorney, Agent, or Firm*—Riches, McKenzie & Herbert

[57] ABSTRACT

A prefabricated corner bead for placement along a wall corner edge is disclosed. The corner bead includes an elongate metal rib bent which is along its longitudinal axis to define a pair of laterally extending flanges. The corner bead further includes a pair of mesh strips, with each mesh strip overlapping and secured to each flange. The mesh strips carry a pressure sensitive adhesive, which may be activated by the application of pressure thereto, to adhere the mesh to the wall and thereby securing the corner bead about the corner edge. Once the corner bead is secured about the corner edge a covering layer of joint compound may be applied thereto to conceal the corner bead and provide a finished wall corner.

19 Claims, 3 Drawing Sheets

40
32b
14
32a
28a
20
12
34a
10
34b
24
22
36a
28b
16
36b
40

46
30
14
34a
44
12
24
34b
D
30
16
46
10'
14'
30'
16'
20'
22'

30'

PREFABRICATED CORNER BEAD

BACKGROUND OF THE INVENTION

1. Field of the Invention

The present invention relates generally to a corner bead for finishing a corner edge of a wall, and more particularly, to a preformed corner bead adapted for quick and simplified placement in an operative position secured along the corner edge, ready for a finishing layer of joint compound or the like to be applied thereto.

2. Description of the Prior Art

In the erection of plaster walls, wallboards or drywall sheets, hereafter referred to generally as drywall, it is known to provide a corner bead along inside and outside corner edges where two sheets of drywall join.

Known corner beads typically comprise rigid strips of steel which have been bent axially into an "L" shape, forming side flanges or shoulders which extend from each other in cross-section at an 90° angle.

In use, the corner beads are manually held along a corner formed by two intersecting sheets of drywall so that the metal flanges overlap the adjacent drywall sheet. Nails are driven through each of the flanges into the drywall sheets, securing the corner bead in place along the corner edge. A covering layer of joint compound, spackle or the like is then applied over the corner bead, and feathered smooth over the flanges with the adjacent drywall to conceal the corner bead and provide a sharply-defined and aesthetically pleasing finished corner.

A difficulty with conventional corner beads is that that the nailing of the corner bead in place is awkward, time consuming and inconvenient.

A further difficulty arises in that the nails used in securing the corner bead to the drywall frequently twist on nailing, with the result that the nail heads do not rest flush against the flanges. The twisting of nails thereby increases the difficulty of the task of covering the nails and corner bead by the overlying layer of joint compound.

To ensure the corner bead provides adequate strength to the corner edge, and to provide a sufficiently wide nailing surface, the flanges of conventional metal corner beads extend in the lateral direction from the axial bend a distance of 1.25 to 2.5 inches. The sizing of conventional corner beads is disadvantageous in that the amount of steel required in manufacture increases both the materials cost, and as well, the weight of the product, adversely affecting the number of corner beads which can be easily carried or shipped.

In an attempt to overcome some of the disadvantages of conventional corner beads, U.S. Pat. No. 5,131,198 to Ritchie et al., which issued Jul. 21, 1992, discloses a composite corner bead having paper flanges which are attached by a heat melted adhesive to a metal core member. The corner bead disclosed in U.S. Pat. No. 5,131,198, however, continues to suffer the disadvantage that it must be manually held and then nailed in place prior to the application of the finishing layer of joint compound.

It is also known to secure the composite corner bead shown in U.S. Pat. No. 5,131,198 along a wall corner by the use of joint compound or the like. The use of the paper composite corner bead together with joint compound is disadvantageous in that a special tool or applicator box is required to roll into the corner bead a V-shaped layer of joint compound approximately ⅛ inch thick.

The applicant has considered precoating a corner bead with a layer of glue or adhesive, in a similar manner as the plastic corner edge protecting guard disclosed in U.S. Pat. No. 4,012,878 to Elligson, issued Mar. 22, 1977. There exists the difficulty that a corner bead precoated with a conventional adhesive would require preliminary preparation prior to its placement. For example, such preliminary preparation may include the wetting of a preapplied dry adhesive, to tackify the adhesive. Alternately a covering release sheet which has been applied over a preactivated adhesive may be removed. Corner beads precoated with a conventional adhesive in the manner of U.S. Pat. No. 4,012,878 would, however, suffer the disadvantages of increased inconvenience and waste, as well as increased manufacturing difficulties. A further disadvantage in providing a corner bead precoated with a conventional adhesive is that the adhesive would tend to bond the corner bead to the drywall immediately and permanently on contact therewith. The immediate bonding of the corner bead to the drywall would therefore prevent movement of the corner bead to permit its adjustment to a final optimal position over the corner edge.

SUMMARY OF THE INVENTION

It is an object of the present invention to at least partially overcome the disadvantages of the prior art by providing a corner bead which carries an adhesive for use in quickly and easily securing the corner bead in an operative position along a corner edge of two intersecting sheets of drywall, without the use of nails, screws or other mechanical fasteners.

Another object is to provide an improved corner bead which is preformed for immediate use once shipped, allowing the corner bead to be positioned along a corner edge without the requirement of preliminary preparation, as for example, by first wetting or applying a coating layer of joint compound or an adhesive to the corner bead or wall corner, or the necessity of removing protective coverings or the like.

Another object is to provide a preformed corner bead which incorporates a minimal amount of steel to reduce both the costs of materials in manufacture and the shipping weight.

A further object of the invention is to provide a preformed corner bead which carries a pressure sensitive adhesive for securing the corner bead in position and which does not immediately bond to the drywall surface on contact therewith, so as to permit adjustment of the final position of the corner bead.

In accordance with the present invention, a preformed corner bead is provided for placement along a drywall corner edge. The corner bead includes an elongate central corner forming member which is bent along its longitudinal axis to define a pair of laterally extending flanges. Flexible mesh strips overlap and are secured to each of the flanges to provide a surface which is receptive to a covering layer of joint cement. An inwardly facing surface of each mesh strip carries an adhesive which when activated, secures the corner bead to the wall in an operative position with the axis of the corner forming member in juxtaposition with the drywall corner and the mesh strips overlapping and secured to the adjacent drywall sheets. In this manner, the preformed corner bead may be positioned along the corner edge and secured in the operative position quickly and easily by the adhesive without the requirement of nailing.

Preferably, the adhesive carried by the mesh strips is a pressure sensitive adhesive which is activated to secure the corner bead in the operative position only upon the application of a minimum positive pressure to the corner forming member and/or the mesh strips. By the mesh strips "carrying" the pressure sensitive adhesive it is generally meant that the strips hold, retain, are coated by or are impregnated with the adhesive.

Providing a preformed corner bead having a pressure sensitive adhesive advantageously eliminates preliminary prepatory steps such as first wetting the strips to tackify the adhesive, or removing release sheet coverings prior to the placement of the corner bead along the corner edge. Further, the use of a pressure sensitive adhesive permits the corner bead to be placed along the corner and its final position then adjusted prior to the activation of the adhesive. As is to be appreciated, by the use of pressure sensitive adhesive; the corner bead is not bound to the drywall immediately once the mesh strips are moved into contact therewith. After initial placement of the axis of the corner forming member in juxtaposition with the corner edge, final adjustments may be made in the positioning of the corner bead prior to the application of the required positive pressure to secure the corner bead in place.

Preferably, the corner forming member comprises a metal rib, which may be either rigid or deformable so as to permit adjustment in the angle between the two flanges. The mesh strips, are also preferably formed from a flexible material such as cloth or fiberglass. With the preformed corner bead secured in the operative position, joint compound may be then applied and feathered over the mesh strips with the adjacent drywall sheets, forming a smooth continuous planar surface from the adjacent portions of the drywall sheets to axis of the corner bead.

More preferably the mesh strips overlap, and are secured to, the outer facing surface of each of the flanges. By overlapping the metal flanges, the mesh strips provide a surface to which the covering layer of joint compound better adheres.

Accordingly, in one of its aspects, the present invention resides in a preformed corner bead for drywall construction comprising, corner forming means having a central axis, said corner forming means bent along said central axis to define a pair of flanges extending laterally therefrom at an angle relative to each other, and joining means for securing said corner bead in an operative position with the central axis of said corner forming means juxtaposed with a wall corner, said joining means comprising a pair of flexible mesh strips, each of said mesh strips overlapping and being secured to an associated one of said flanges, said flexible mesh strips carrying a pressure sensitive adhesive for retaining said corner bead in said operative position to permit the application of a joint compound or the like over the corner forming means and joining means to form a finished corner.

In another aspect, the present invention resides in a method of manufacturing a preformed corner bead for drywall construction comprising, a rib member having a central axis, said rib member bent along said central axis to define a pair of flanges extending laterally therefrom at an angle relative to each other, joining means for securing said corner bead in an operative position with the central axis of said corner forming means juxtaposed with a wall corner, and an adhesive coating, said joining means comprising a pair of flexible mesh strips and a pressure sensitive adhesive, wherein a first edge portion of each mesh strip overlies an associated one of said flanges and is secured thereto by said adhesive coating, said flexible mesh strips carrying said pressure sensitive adhesive for retaining said corner bead in said operative position, said method comprising the steps of passing a strip of steel through a roll forming machine to form said rib member; positioning said first edge portion of each said mesh strip over said associated flange, applying a wet coat of said adhesive coating to each of said flanges over the first edge portions of the mesh strips and curing said adhesive coating to bond said mesh strips to said rib member.

In a further aspect, the present invention resides in a method of finishing a drywall corner using a preformed corner bead comprising, corner forming means having a central axis, said corner forming means bent along said central axis to define a pair of flanges extending laterally therefrom at an angle relative to each other, and joining means for securing said corner bead in an operative position with the central axis in juxtaposition with said drywall corner, said joining means comprising a pair of flexible mesh strips, each of said mesh strips overlapping and being secured to an associated one of said flanges and carrying a pressure sensitive adhesive activatable to secure said corner bead in said operative position, said method comprising the steps of positioning said central axis of said corner forming means in juxtaposition with said wall corner, applying a positive pressure to said mesh strips to activate said pressure sensitive adhesive to secure said corner bead in said operative position, and applying a joint compound over said corner bead.

BRIEF DESCRIPTION OF THE DRAWINGS

Further objects and advantages of the invention will appear from the following description taken together with the accompanying drawings in which.

DESCRIPTION OF THE PREFERRED EMBODIMENTS

Figure 1:
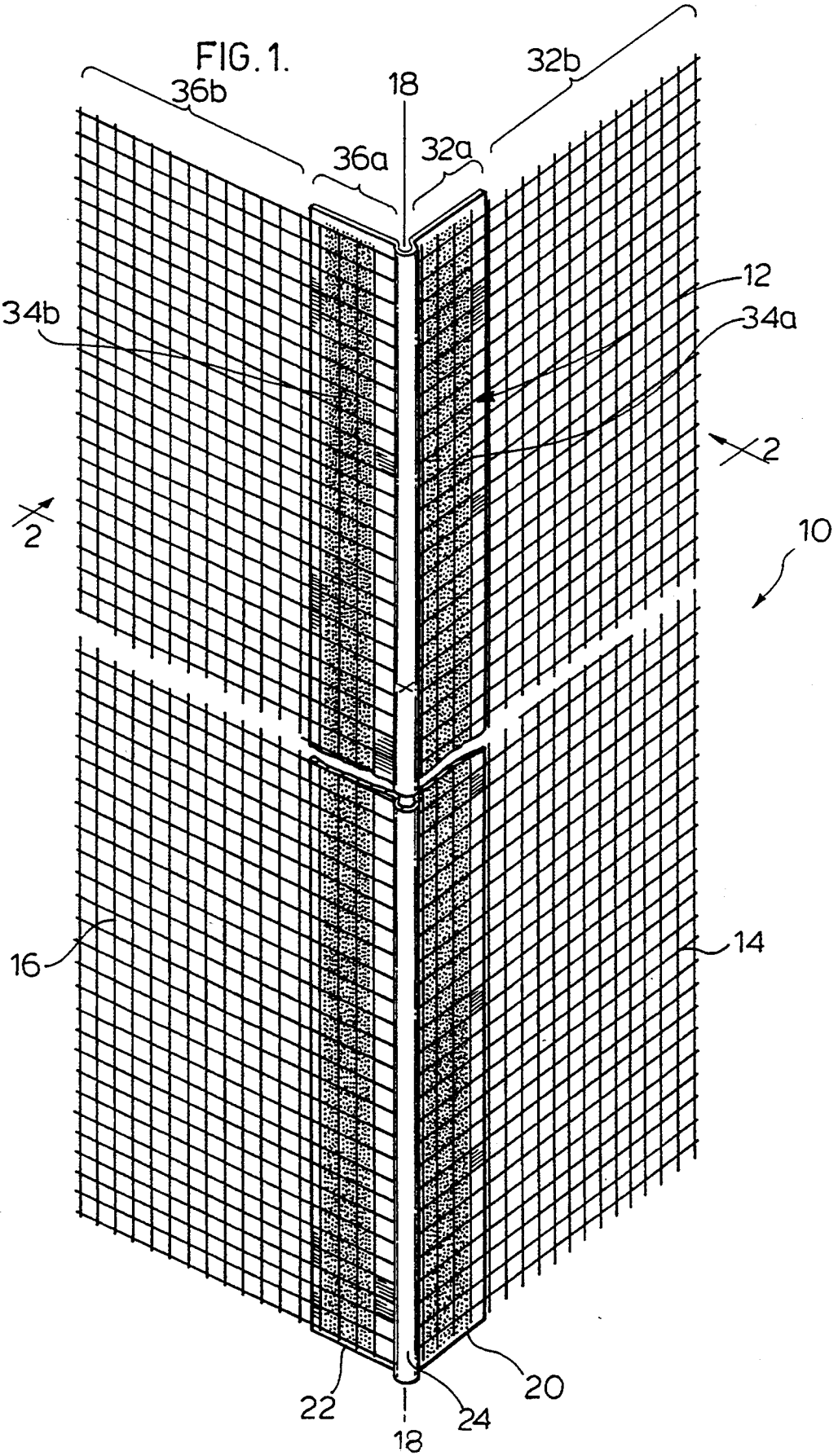
FIG. 1 is a partial perspective view of a preformed corner bead according to the present invention.
Figures 2, 3, 4:
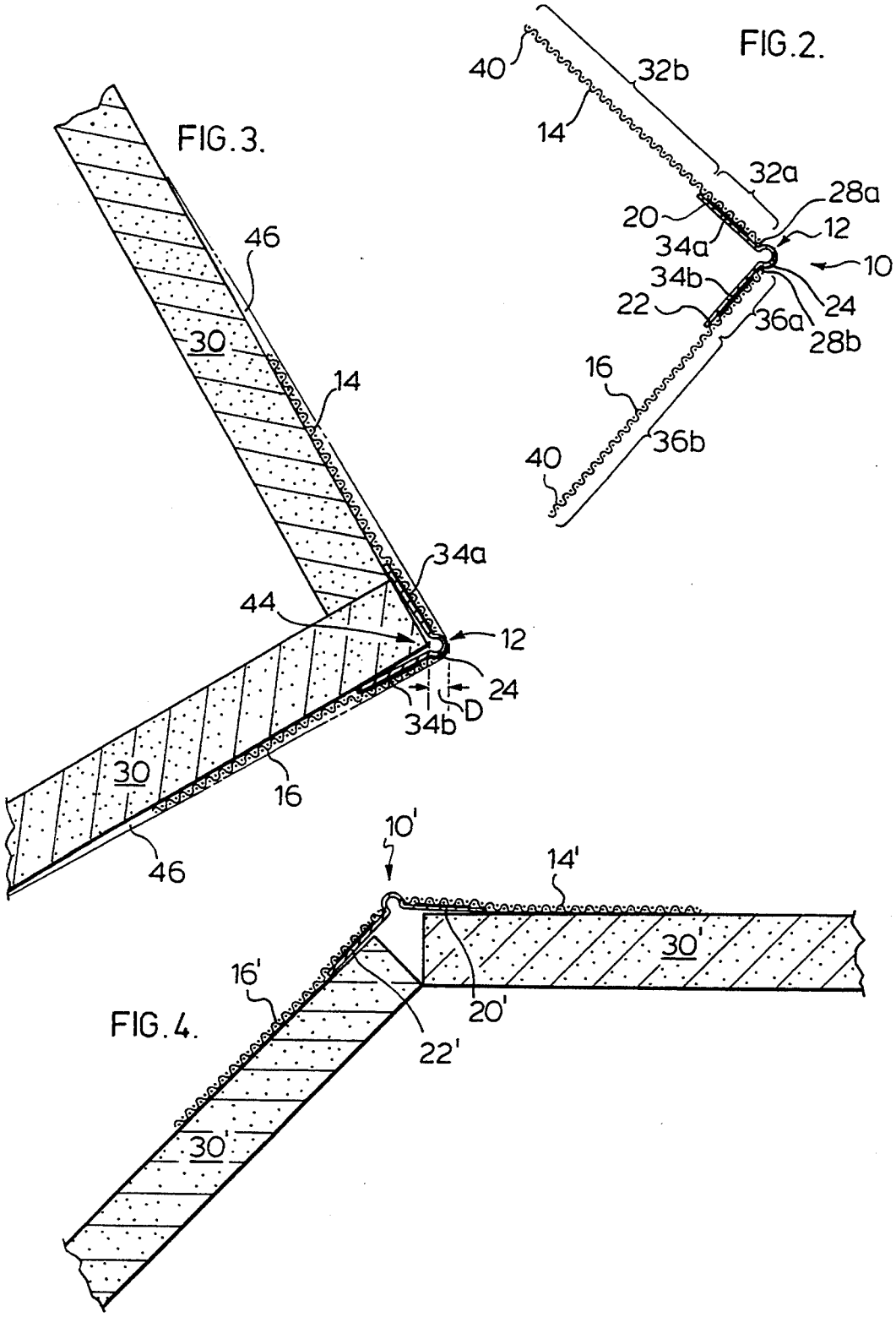
FIG. 2 is a cross-sectional view of the corner bead of FIG. 1 taken along line 2—2.
FIG. 3 is a cross-sectional view of a finished outside corner showing the corner bead of FIG. 2 secured in an operative position along a 90° outside corner.
FIG. 4 is a cross-section view of a corner bead in accordance with a second embodiment of the invention adapted for placement in an operative position along a 135° outside corner.

Reference is now made to FIGS. 1 and 2 which show a preformed corner bead 10 which has been precut to a desired standard length for immediate placement along an outside wall corner (designated by reference numeral 44 in FIG. 3). The corner bead 10 comprises generally a rigid central rib 12 and a pair of elongated flexible mesh strips 14,16.

The rib 12 is formed from an elongated rectangular strip of galvanized steel which is bent along its longitudinal axis 18 into an "L-shape" to define a pair of laterally extending flanges 20,22. The flanges 20,22 are joined by an axially aligned rounded or bull nose portion 24. As seen best in FIG. 2, the rounded nose portion 24 preferably forms an arcuate segment of greater than 90°, to form step-down shoulders **28*a*,28*b* where the nose portion 24 joins the flanges 20,22. The flanges 20,22** extend relative to each other at an angle of not more than 90°, and preferably an angle of approximately 84°.

To provide sufficient rigidity, the rib 12 is formed from 32 gauge steel having a thickness of approximately 0.012 inches, with each flange 20,22 having a lateral width of approximately 0.75 inches. In this configuration the rib 12 is large enough to provide the required corner reinforcement, while still small enough to minimize weight and materials cost.

The mesh strips 14,16 are formed from elongate rectangular strips of woven or knitted fiberglass which preferably have a mesh size of a 9×9 grid per square inch and a thickness of approximately 0.008 inches. Each of the mesh strips 14,16 extends substantially the entire length of the rib 12, and has a width of between 1 to 3 inches and more preferably approximately 1.25 inches. By the use of mesh strips 14,16 having a thickness of approximately 0.008 inches, the corner bead 10 is provided with a sufficiently small cross-sectional profile so as to permit easy concealment with a covering layer a joint compound (shown as 46 in FIG. 3).

As seen best in FIGS. 2 and 3, a first edge portion **32*a* of mesh strip 14 overlaps the surface of flange 20. The edge portion 32*a* is permanently secured to flange 20 by a layer of adhesive 34*a* such that the second opposite edge portion 32*b* of the strip 14 projects beyond the rib 12 away from the rounded nose 24. The edge portion 32*a* is preferably secured to a surface of the rib 12 which faces outwardly away from the drywall 30, when the corner bead 10 is secured in a operative position for use in the manner later described with reference to FIG. 3**.

Similarly, a first edge portion **36*a* of mesh strip 16 overlaps and is secured to an outwardly facing surface of flange 22. The edge portion 36*a* is permanently secured to the flange 22 by a layer of adhesive 34*b* such that a second opposite edge portion 36*b* of the mesh strip 16 projects beyond the rib 12 away from the rounded nose 24. The edge portion 36*a* is also preferably secured to a surface of the rib 12 which faces outwardly away from the drywall 30, when the corner head 10** is secured in the operative position.

The adhesive layers **34*a*,34*b*** comprise a water emulsified adhesive, such as Ucar Latex 6510* manufactured by Union Carbide or Rhoplex AC264* manufactured by Rohmand Haas Company. Water emulsified adhesives advantageously spread evenly along the flanges 20,22, substantially eliminating beading or high spots associated with hot melt adhesives, and which may be difficult to later conceal. As such, when dry, adhesive layers **34*a*,34*b*** have a substantially uniform thickness of less than approximately 1.5 millimeter and more preferably approximately 1 mm.

*Trademark

Each mesh strip 14,16 carries a pressure sensitive adhesive 40, such as WH-154* manufactured by Rohmand Haas Company. The pressure sensitive adhesive 40 is carried on the surfaces of the mesh strips 14,16 which face inwardly towards the drywall 30, when corner bead 10 is secured in the operative position. When activated, the pressure sensitive adhesive 40 bonds the respective second edge portions **32*b*,36*b* of each mesh strip 14,16 to the drywall 30. By bonding the mesh strips 14,16 to the drywall 30, the corner bead 10 is secured in an operative position about the corner edge 44, with the rib axis 18 in juxtaposition with the corner edge 44. The pressure sensitive adhesive 40 is selected only to be activated to bond the corner bead 10 to the drywall 30 upon the application of a minimum positive pressure to the mesh strips 14,16**.

* Trademark

With the corner bead 10 secured in the operative position over the corner edge 44 a covering layer of joint compound 46 may be applied over the entire corner bead 10. As is to be appreciated, the use of mesh strips 14,16 advantageously permit movement of the joint compound 46 into the interstices of the mesh into direct contact with the underlying drywall 30. Once dry, adhesion of the joint compound 46 to both the mesh strips 14,16 and the drywall 30 acts to further secure the corner bead 10 along the corner edge 44.

The added adhesive effect achieved by the use of mesh strips 14,16 together with the joint compound 46, eliminates the requirement that the pressure sensitive adhesive 40 have high tack or adhesive properties. As such a pressure sensitive adhesive 40 may be employed which has a lesser adherence so as not to permanently bond the corner bead 10 to the drywall 30 on contact therewith. The pressure sensitive adhesive 40 is more preferably selected to maintain its tack or adhesive properties to permit the removal and reattachment of a corner bead 10 which has been incorrectly positioned.

The use of the corner bead 10 may be described with reference to FIG. 3. A premanufactured corner bead 10, preformed and cut to a desired standard length is positioned with the rib axis 18 aligned with the corner edge 44 and the edge portions **32*b*,36*b* overlapping the drywall 30. With the axis 18 in juxtaposition with the corner edge 44, a positive pressure is applied to the second edge portions 32*b*,36*b* of mesh strips 14,16. The application of pressure causes the pressure sensitive adhesive 40 carried by the edge portions 32*a*,36*b* to adhere to the drywall 30, bonding the corner bead 10 over the corner edge 44** in an operative position.

With the corner bead 10 secured to the wall 30 in the operative position, joint compound 46 is applied over the mesh strips 14,16 and rib 12 with a conventional trowel or scraper. The rounded nose portion 24 acts as a guide along which the trowel or other joint compound applicator is moved. The joint compound 46 is feathered from the portion of the drywall 30 adjacent the corner bead 10 to the rounded nose portion 24, covering the corner bead 10.

As shown best in FIG. 3, the rib 12 and mesh strips 14,16 are configured to permit a thin covering layer of joint compound 46, which after sanding, forms the finished or dressed corner. As most of the outer surface 26 of the rib 12 is overlain by the mesh strips 14,16 improved adherence of the joint compound 46 over the metal rib 12 is achieved.

The use of a corner bead 10 incorporating flanges 20,22 which extend relative to each other at an angle smaller than the angle made by the profile outside corner 44 advantageously assists in providing a finished outside corner. The sharper angle between the flanges 20,22, causes their engagement with the drywall 30, resulting in the rounded nose portion 24 extending a distance "D" away from the corner edge 44. Preferably distance "D" is approximately ⅛ inches. This configuration provides clearance for the trowel used to apply joint compound 46, preventing its interference with the flanges 20,22 and mesh strips 14,16, as it is guided in movement with one edge resting on the nose portion 24 and the other edge resting on the adjacent drywall 30.

Reference is now made to FIG. 4 which shows a second embodiment of the invention. Corner bead 10' is designated with like numerals identifying similar components. Corner bead 10' is substantially identical to the corner bead 10 shown in FIG. 2 in both structure and use, but for being configured for placement along an outside wall corner having an angle of 135°. In corner bead 10' the rib 12' is bent so that the flanges 20',22' extend relative to each other at an angle between 125° to 135°, and more preferably at an angle of approximately 129°.

Figure 5:
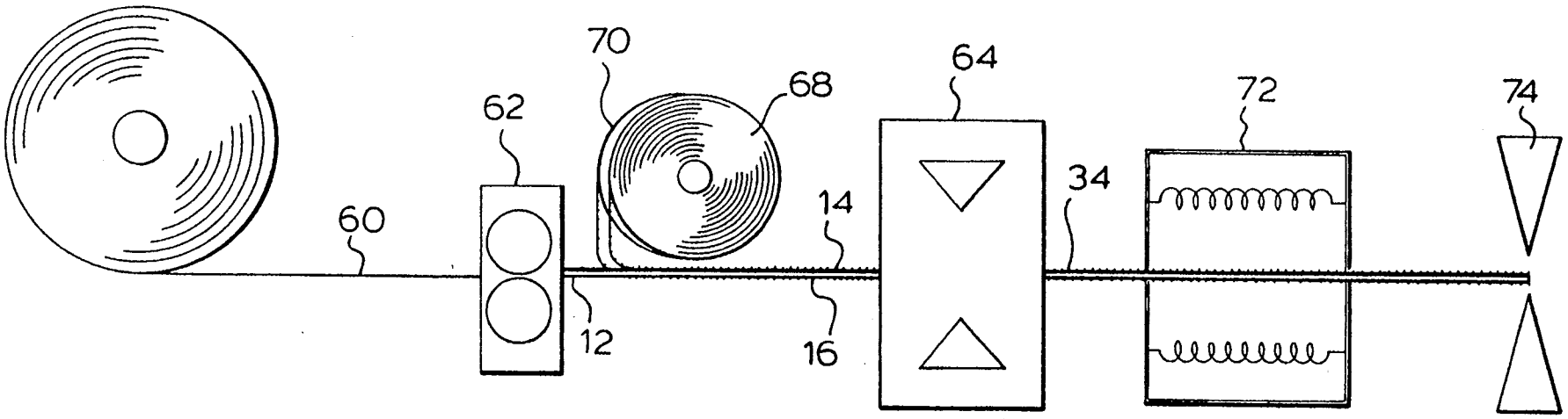
FIG. 5 is a schematic illustration of an assembly line for manufacturing a corner bead in accordance with the present invention.

In a preferred form of manufacture, the corner bead 10 of the present invention is formed in a continuous step process illustrated schematically in FIG. 5.

A flattened coiled steel strip 60 is unwound and passed through a roll forming machine 62. The roll forming machine 62 bends the metal strip 60 along its axis to form the continuous angled rib 12, having the rounded nose 24 and angularly extending flanges 20,22. As the rib 12 moves from the roll forming machine 62, woven mesh strips 14,16 which carry pressure sensitive adhesive 40 are unwound from mesh coils 68,70 and secured to the continuous rib 12 by the adhesive 40, with the first edge portion **32*a*,36*a* of each strip 14,16 applied over each respective flange 20,22**.

A spray applicator 64 next applies a wet coat of water emulsified adhesive 34 over the flanges 20,22 and edge portions **32*a*,36*a* in a wet coat thickness of approximately 2 mm. The adhesive 34 is applied to the surface of each of the flanges 20,22 which will face outwardly when the corner bead 10 is secured in an operative position. The water emulsified adhesive 34** is selected to shrink as it dries to a substantially uniform thickness of not more than 1.5 millimeters.

The adhesive 34 is then allowed to cure or dry, to permanently bond the mesh 14,16 to the rib 12. Curing or drying may be achieved by either passing the continuous length of corner bead 10 through a heating chamber 72, or by air drying.

Once the adhesive 34 dries, the corner bead 10 is pre-cut into standard lengths of 7, 8, 9, 10 or 12 feet by a press cutter 74 or the like. The prefabricated corner beads 10 which have been pre-cut to the desired length may be then stacked together in a nested relationship and packaged for shipment.

Providing a corner bead 10 which is both lighter as a result of a reduction in the amount of metal used and which is secured in place by a pressure sensitive adhesive allows for the shipment in a single package, a number of corner beads 10 which have been preformed. Further, the pressure sensitive adhesive 40 advantageously prevents the mesh strips 14,16 from adhering to strips of adjacent nested corner beads without the inconvenience and added expense of providing the strips 14,16 with release sheets. As is to be appreciated, the shipment of a number of preformed corner beads 10 in a single package advantageously reduces transportation costs.

The inventor has further discovered that the use of a water emulsified adhesive 34 to attach the mesh strips 14,16 to the rib 12 advantageously reduces the likelihood of the adhesive 34 reacting with or staining the covering joint compound or other covering material, which otherwise may produce discolorations in the finished corner.

While the preferred embodiment discloses the use of a rigid steel rib and fiberglass mesh strips, the invention is not so limited. Both the rib and/or mesh strips may equally be manufactured from plastics, or other metals including stainless steel, aluminum, tin or copper, of either a flexible or rigid construction.

Similarly, while providing a preformed corner bead 10 having a rounded nose portion 24 is advantageous in assisting the guiding movement of a trowel, the rounded nose portion 24 is not essential.

Although the disclosure describes preferred embodiments of the invention, the invention is not so limited to these particular embodiments. Many variations and modifications will now occur to those skilled in the art. For a definition of the invention, reference is made to the appended claims.

The embodiments of the invention in which an exclusive property or privilege is claimed are defined as follows:

1. A preformed corner bead for drywall construction comprising, corner forming means having a central axis, said corner forming means bent along said central axis to define a pair of flanges extending laterally therefrom at an angle relative to each other, and joining means for securing said corner bead in an operative position with the central axis of said corner forming means juxtaposed with a wall corner, said joining means comprising a pair of flexible mesh strips, each of said mesh strips overlapping and being secured to an associated one of said flanges, said flexible mesh strips carrying a pressure sensitive adhesive for retaining said corner bead in said operative position to permit the application of a joint compound over the corner forming means and joining means to form a finished corner.

2. A preformed corner bead as claimed in claim 1 wherein said corner forming means comprises an elongated generally rectangular rib member.

3. A preformed corner bead as claimed in claim 2 further comprising an adhesive coating, each of said mesh strips including first and second elongate edge portions, wherein said first edge portion of each mesh strip overlies said associated flange, said first edge portion secured to said associated flange by said adhesive coating.

4. A preformed corner bead as claimed in claim 3 wherein said rib member further comprises a rounded nose portion along said central axis.

5. A preformed corner bead as claimed in claim 3 wherein said first edge portions of said mesh strips overlap an outward facing surface of each of said associated flange.

6. A preformed corner bead as claimed in claim 5 wherein said mesh strips comprise fiberglass.

7. A preformed corner bead as claimed in claim 6 wherein said rib member comprises metal.

8. A preformed corner bead as claimed in claim 6 wherein said rib member further comprises a rounded nose portion extending along said central axis.

9. A preformed corner bead as claimed in claim 8 wherein said rib member comprises 32 gauge steel.

10. A preformed corner bead as claimed in claim 9 wherein said flanges extend laterally from said central axis at an angle of approximately 84°.

11. A preformed corner bead as claimed in claim 10 wherein each of said flanges have a laterally extending width of approximately 0.75 inches.

12. A preformed corner bead as claimed in claim 9 wherein said flanges extend laterally from said central axis at an angle of approximately 129°.

13. A preformed corner bead as claimed in claim 11 wherein said mesh strips are approximately 1.25 inches in width.

14. A preformed corner bead as claimed in claim 12 wherein said mesh strips are approximately 1.25 inches in width.

15. A preformed corner bead as claimed in claim 13 wherein said adhesive dries to a coating of less than 2 millimeter thick.

16. A preformed corner bead as claimed in claim 15 wherein said coating is approximately 1 millimeter thick.

17. A preformed corner bead as claimed in claim 8 wherein said mesh strips comprise a 9×9 grid/square inch mesh size.

18. A method of finishing a drywall corner using a preformed corner bead comprising, corner forming means having a central axis, said corner forming means bent along said central axis to define a pair of flanges extending laterally therefrom at an angle relative to each other, and joining means for securing said corner bead in an operative position with the central axis in juxtaposition with said drywall corner, said joining means comprising a pair of flexible mesh strips, each of said mesh strips having an edge portion overlapping and being secured to an associated one of said flanges, with a remaining portion of each mesh strip projecting beyond said associated flange away from said central axis, said mesh strips carrying a pressure sensitive adhesive activatable to attach said remaining portion of each said mesh strip to associated portions of drywall adjacent said corner, said method comprising the steps of, positioning said central axis of said corner forming means in juxtaposition with said wall corner with said remaining portion of each said mesh strip overlapping the associated portions of drywall, applying a positive pressure to said mesh strips to activate said pressure sensitive adhesive to attach each said remaining portions of said mesh strips to said associated portion of drywall and thereby secure said corner bead in said operative position, and applying a joint compound over said corner bead.

19. A preformed corner bead for drywall construction comprising, corner forming means having a central axis and defining a pair of flanges extending laterally from said central axis at an angle relative to each other, and a pair of elongated flexible mesh strips for securing said corner bead in an operative position with the central axis of said corner forming means juxtaposed with a wall corner, each of said mesh strips having an edge portion overlapping and being secured to an associated one of said flanges, with a remaining portion of each of said mesh strips projecting beyond said associated flange away from said central axis, said flexible mesh strips carrying a pressure sensitive adhesive for attaching said remaining portion of each said mesh strip to an associated portion of drywall adjacent said wall corner, and thereby retain said corner bead in said operative position to permit the application of a joint compound over the corner forming means and mesh strips to form a finished corner.

* * * * *